United States Patent [19]

Rudnick

[11] 4,242,195

[45] Dec. 30, 1980

[54] EXTRACTION OF TAR SANDS OR OIL SHALE WITH ORGANIC SULFOXIDES OR SULFONES

[75] Inventor: Leslie R. Rudnick, Trenton, N.J.

[73] Assignee: Mobil Oil Corporation, New York, N.Y.

[21] Appl. No.: 107,950

[22] Filed: Dec. 28, 1979

[51] Int. Cl.[3] ..... C10G 1/100
[52] U.S. Cl. ..... 208/11 LE
[58] Field of Search ..... 208/11 LE

[56] References Cited

U.S. PATENT DOCUMENTS

| | | | |
|---|---|---|---|
| T700,489 | 4/1969 | Long et al. | 208/11 LE |
| 2,831,039 | 4/1958 | Nevitt | 208/323 |
| 3,005,032 | 10/1961 | Makin | 585/856 |

*Primary Examiner*—Delbert E. Gantz
*Assistant Examiner*—Joseph A. Boska
*Attorney, Agent, or Firm*—Charles A. Huggett; Edward J. Trojnar

[57] ABSTRACT

Tar sands and oil shales are extracted with aliphatic or aromatic sulfoxides or sulfones whereby both non-polar organic constituents, e.g., hydrocarbons, and more polar constituents, e.g., phenols, are solubilized and recovered for conventional processing.

7 Claims, No Drawings

EXTRACTION OF TAR SANDS OR OIL SHALE WITH ORGANIC SULFOXIDES OR SULFONES

BRIEF SUMMARY OF THE INVENTION

Hydrocarbons and other constituents of tar sands and oil shale, including polar constituents, are extracted with extraction solvents predominantly comprising organic sulfoxides and sulfones. The polar character of the sulfoxides and sulfones permits the extraction of highly functional constituents which precipitate out when treated with solvents such as n-alkanes, having low polarity.

DETAILED DESCRIPTION OF THE INVENTION

As sources of crude oil become less available, there is a greater need to develop known but less easily handled petroleum resources. One such resource is tar sand, a sandy material having water and tarry organic material within its interstices. Large deposits are found in various parts of the world. For example, one of the largest known deposits of tar sands lies in the Athabasca district of Alberta Canada, and extends for many thousands of square miles. Another difficult to handle resource found in various parts of the world is oil shale.

Tar sands and oil shales contain tremendous reserves of hydrocarbon constituents. For example, the oil in the sands may vary from about 5 to 21% by volume, generally in the range of about 12% by volume. The gravity of the oil ranges from about 6° to 10° API, generally about 8° API. The tar sand beds may range from about 100 to 400 feet thick, covered by an overburden from about 200 to 300 feet. A typical oil recovered from the sands has an initial boiling point of about 300° F., 1.0% distillation to 430° F., 20% distillation to 650° F., and 50.0% distillation to 980+F. Tar sands represent a significant petroleum resource which may ease the growing shortage of sources available to satisfy our petroleum demand. However, before the petroleum material in the tar sand can be employed in ordinary oil refining operation, it must be separated from the solid, sandy material. Both oil shale and tar sand suffer the disadvantage of requiring additional processing steps over conventional forms of oil recovery.

The high cost of separating tar from sand and oil from shale has been the greatest restriction on the use of these materials as economical sources of crude petroleum. It is, therefor, essential to the commercial feasibility of any process for the recovery of hydrocarbons that costs be low while maintaining a high recovery of hydrocarbons and other valuable constituents.

The peculiar nature of the tar sand aggregate has heretofore frustrated attempts to attain these goals, though, some are relatively soft and free-flowing while others are very hard and rocklike. For example, the tar sands of the Athabasca district are composed of an almost pure silica sand, each grain of which is surrounded by a layer of water which, in turn, is surrounded by a film of oil. The oil film may also contain significant quantities of clay. The interstices between the grains are largely filled with oil. This construction of the aggregate is believed to exist because the water content of the tar sands has a greater surface tension than the oil. Although it is recognized that the exact compositions of the tar sands vary, even in an immediate location, the foregoing construction of the tar sand aggregate is apparently a general characteristic of the sands.

Similarly, considerable difficulty has been experienced in extracting oil from oil shale. Various methods have been prepared for the recovery of hydrocarbons from tar sands and oil shales, including direct fluid coking and retorting. These thermal processes are uneconomical due to the fact that the heat imparted cannot be effectively and efficiently recovered. Accordingly, attention has more recently focused on solvent extraction as a general method which may provide a commercially feasible process for the treatment of tar sands and oil shale.

Considerable effort has been directed toward the selection of appropriate solvents or solvent systems for extraction of the organic constituents from tar sands and oil. A list of known solvents for this purpose appears, for example, in British Pat. No. 1,495,722. Included among the solvents mentioned are aromatic hydrocarbons; aliphatic hydrocarbons; oxygen containing compounds such as phenols, alcohols, aldehydes, ketones, ethers, and esters; aliphatic and aromatic amines; halogenated hydrocarbons; as well as sulfur compounds such as alkyl thiophenes and carbon disulfide. Organic sulfoxides and sulfones are not mentioned. While it is known that sulfoxides or sulfones are suitable for certain liquid-liquid extractions to selectively extract certain components from specific mixtures it is not believed that the use of sulfoxides or sulfones has been previously proposed for extraction of organic constituents from tar sands or oil shale. Examples of patents which teach the use of sulfoxides and sulfones in liquid-liquid extractions are U.S. Pat. Nos. 2,033,942, 2,831,039 and 3,005,032.

In accordance with this invention the organic matter of tar sand or oil shale is extracted by mixing with an extraction solvent predominantly comprising organic sulfoxide having the formula $$R-\overset{\overset{\displaystyle O}{\|}}{S}-R_1 \quad ;$$

an organic sulfone having the formula $$R-SO_2-R_1;$$

or mixtures thereof in which R and $R_1$ are the same or different and are aliphatic radicals having from 3 to 10 carbon atoms, cycloaliphatic radicals containing from 5 to 10 carbon atoms, or aromatic radicals containing 6 to 10 carbon atoms; and then separating the solvent containing dissolved organic matter from the sand or shale constituent by known procedures such as filtration or centrifuging. The extraction solvent can in some instances be advantageously heated and can be used in mixtures with known extraction solvents. Preferably, the sulfoxide, sulfone or mixtures thereof constitute the major proportion of such mixtures.

The preferred aliphatic radicals in the sulfoxides or sulfones are alkyl radicals and the preferred aromatic radicals are phenyl and phenyl substituted with hydroxy or alkyl, for example, phenyl, hydroxy phenyl, tolyl or xylyl.

Depending on the nature of the particular extractant and material to be extracted their weight ratio can vary widely from about 10:1 to 1:30, preferably in the range of 5:1 to 1:5.

The extractants used in this invention are good solvents for a wide range of organic constituents found in tar sands and oil shales, both the non-polar constituents such as alkanes and constituents which are somewhat polar due to the presence of functional groups. An additional advantage of the extractants of this invention is that they can be prepared economically from materials such as alkenes, alkanes, phenols, cresols, toluene, xylene and sulfur gases which are available at sites where petroleum is processed. It is also an advantage that pure solvents are not necessary since mixtures of various sulfoxides or sulfones, or sulfoxides and sulfones are suitable for use in this invention.

The sulfoxides and sulfones used in the process of this invention can be prepared by conventional methods known in the art. A general discussion of methods of preparation is found in Migrichian V., Organic Synthesis, Volume I, Reinhold Publishing Corporation, New York, 1957, pages 92, 93 and 671.

Sulfoxides and sulfones can be substituted for the solvents used in many of solvent extraction processes known in the art. Accordingly, the particular processing steps and conditions used are not critical to this invention which primarily depends on the use of the particular extraction solvents described herein.

I claim:

1. A process for recovering organic matter from tar sands or oil shale comprising:

(A) mixing tar sand or oil shale with an extraction solvent comprising a sulfoxide of the formula:

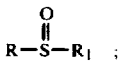

a sulfone of the formula $$R-SO_2-R_1$$

or a mixture thereof; in which R and $R_1$ are the same or different and are aliphatic radicals containing 3 to 10 carbon atoms, cycloaliphatic radicals containing 5 to 10 carbon atoms or aromatic radicals containing 6 to 10 carbon atoms; and (B) separating said solvent containing dissolved organic matter from the sand or shale residue insoluble therein.

2. The process of claim 1 for recovering organic matter from tar sand.

3. The process of claim 1 for recovering organic matter from oil shale.

4. The process of claims 2 or 3 in which R and $R_1$ are alkyl of 3 to 8 carbon atoms.

5. The process of claims 2 or 3 in which R and $R_1$ are phenyl, hydroxy phenyl, tolyl or xylyl.

6. The process of claim 1 in which said extraction solvent is heated to a temperature above 50° C.

7. The process of claim 1 in which said organic matter is separated from said extraction solvent and the extraction solvent is recycled to step (A).

* * * * *